US008387498B2

(12) United States Patent
Stemmer

(10) Patent No.: US 8,387,498 B2
(45) Date of Patent: Mar. 5, 2013

(54) METHOD FOR CUTTING STACKS OF SHEET MATERIAL

(75) Inventor: Frank Stemmer, Babenhausen (DE)

(73) Assignee: Adolf Mohr Maschinenfabrik GmbH & Co. KG, Hofheim am Taunus (DE)

( * ) Notice: Subject to any disclaimer, the term of this patent is extended or adjusted under 35 U.S.C. 154(b) by 359 days.

(21) Appl. No.: 12/719,076

(22) Filed: Mar. 8, 2010

(65) Prior Publication Data

US 2010/0229703 A1 Sep. 16, 2010

(30) Foreign Application Priority Data

Mar. 11, 2009 (EP) ..... 09003511

(51) Int. Cl.
*B26D 7/06* (2006.01)

(52) U.S. Cl. ..... 83/35; 83/36; 83/219

(58) Field of Classification Search ..... 83/35, 36, 83/219, 220, 256, 733, 734, 437.1
See application file for complete search history.

(56) References Cited

U.S. PATENT DOCUMENTS

| | | | | |
|---|---|---|---|---|
| 4,317,397 | A * | 3/1982 | Ess | 83/35 |
| 5,002,108 | A * | 3/1991 | Jenkner | 144/373 |
| 5,311,799 | A * | 5/1994 | Mohr | 83/36 |
| 6,571,674 | B2 * | 6/2003 | Benuzzi | 83/733 |
| 6,601,490 | B1 * | 8/2003 | Gross et al. | 83/27 |
| 8,151,677 | B1 * | 4/2012 | Benuzzi | 83/206 |

FOREIGN PATENT DOCUMENTS

| | | |
|---|---|---|
| DE | 19515705 | 10/1996 |
| EP | 0056874 | 8/1982 |
| EP | 0091714 | 10/1983 |
| EP | 0242762 | 10/1987 |
| EP | 453935 | * 10/1991 |
| EP | 1018408 | 7/2000 |

* cited by examiner

*Primary Examiner* — Stephen Choi
(74) *Attorney, Agent, or Firm* — Price Heneveld LLP

(57) ABSTRACT

A method for producing stacks of sheet material transversely and longitudinally cuts rectangular starting stacks using a single cutting machine and short travel paths for the material being cut. The starting stack arranged on a rear table is pushed forward under a cutting blade and is separated into at least two partial stacks which are aligned, rotated 90 degrees and pushed back under the cutting blade to form a plurality of finished partial stacks.

14 Claims, 10 Drawing Sheets

METHOD FOR CUTTING STACKS OF SHEET MATERIAL

CLAIM OF PRIORITY

Applicant hereby claims the priority benefits under the provisions of 35 U.S.C. §119, basing said claim of priority on European Patent Application Serial No. 09 003 511.4, filed Mar. 11, 2009. In accordance with the provisions of 35 U.S.C. §119 and Rule 55(b), a certified copy of the above-listed European patent application will be filed before grant of a patent.

BACKGROUND OF THE INVENTION

The invention relates to a method for producing a plurality of stacks of sheet material from an initial stack of larger sheets by transversely and longitudinally cutting the stack of larger sheets using a single cutting machine.

In practice, it is frequently necessary to further process stacks of relatively lager sheet-like materials, such as stacks of large, individually printed sheets of paper. The edges of these large, parallelepiped or rectangular block-shaped stacks (called "initial or starting stacks" when used in the present application) are cut to produce a rectangular edge-trimmed starting stack with defined edge lengths. As a rule, this trimming occurs prior to forming the partial stacks, hereinafter called the "finished stacks", that constitute the final cut products. The larger initial stack that has been trimmed on all four edges or sides is called the edge-trimmed starting stack in the context of the present invention. This edge-trimmed starting stack is then cut multiple times in one direction, each step creating a smaller partial stack. If necessary, an intermediate cut like that described in EP 0 056 874 A2 can be made after each cut that divides the partial stack before the next utility cut is made. This intermediate cut ensures precise, aligned cutting without the risk of cutting into printed labels on the sheets, for instance. Any waste that occurs is disposed of with this intermediate step, as is described for instance in EP 0 056 874 A2. After the edge-trimmed starting stack has been cut in one direction to create a rectangular full stack, as it is known in the terminology used for the present invention, this full stack is rotated 90 degrees. Then, it is cut again, and with every cut, a plurality of partial stacks is produced for creating a full utility stack.

The edge-trimmed starting stack thus undergoes multiple transverse cuts and then multiple longitudinal cuts. It is also possible to perform the aforesaid intermediate cuts in addition to the cuts with the longitudinal cut that follows the transverse cut. The rectangular full stack, as it is known in the terminology used for the present invention, is created from a plurality of partial stacks at the end of the cutting process.

Heretofore, two cutting machines are used for the described cutting process in which the edge-trimmed starting stack is cut transversely and longitudinally. The cutting planes for these two cutting machines are arranged at a right angle to one another so that, after the edge-trimmed starting stack is cut by the first cutting machine, the full rectangular stack created from the various partial stacks is fed to the other cutting machine without being rotated. This cutting machine then cuts the full rectangular stack. This produces the full stack from the plurality of partial stacks. One such method is described in EP 0 242 762 A2, for instance.

Also already known in the art are processes for converting an edge-trimmed rectangular starting stack to a full stack created from a plurality of partial stacks by means of a single cutting machine using transverse and longitudinal cuts, as disclosed in EP 0 453 953 A 1. In that document, the edge-trimmed starting stack disposed on a rear table for the cutting machine is advanced to the cutting machine using a back gauge, and the trimmed starting stack is cut by the cutting blade to create the partial stacks. These partial stacks are advanced onto a front table of the cutting machine, and from there, onto a transport base that is positioned on a table arranged to one side of the cutting machine. The partial stacks are rotated from the transverse orientation to the longitudinal orientation, and then moved either onto the transport base, together with the transport base, or after being removed from the transport base. Once the partial stacks have been removed from the transport base, they are placed on a rear table, creating an aligned rectangular full stack, and are advanced using the back gauge. Now, the full stack is separated into the plurality of partial stacks.

This method has a number of different disadvantages. One significant disadvantage is that the material remains on the transport base between the transverse cutting and the longitudinal cutting. This means that the transport base, which has a large surface area, must be moved. In addition, the transport base requires a table surface large enough to accommodate it. This makes it necessary for there to be sufficient space around the cutting machine to guide the transport base around the cutting machine. The transport base requires that it must always be possible to handle a stack arrangement that is essentially equivalent in size to full stack. Thus universal handling is not possible for a series of stacks, and it is not possible to handle a small format unit.

DE 195 15 705 C1 and EP 0 091 714 A 1 describe additional methods for producing utility stacks by transversely and longitudinally cutting rectangular starting stacks made of a plurality of sheets. However, this prior art uses three cutting machines.

EP 1 018 408 A 1 describes a method for cutting stacked, sheet-like material in which a cutting machine and a mobile alignment station that can be connected to it are used for partial stacks that are created during cutting. The mobile alignment station is not used until the starting stack that is present after edge trimming is divided into partial stacks in the one direction and these partial stacks are rotated 90 degrees, so they can then be cut into small partial stacks. The mobile alignment station is connected to the cutting machine in the area of the front table part, so that a straight edge on the mobile alignment station can assume the alignment function and support the partial stacks when they are cut. The cut partial stacks are then removed through a transverse channel formed between the straight edge and another straight edge. This is accomplished by an ejector tool.

SUMMARY OF THE INVENTION

One object of the present invention is to provide a method in which it is possible to use a single cutting machine to cut a starting stack transversely and longitudinally with very short travel paths for the material being cut.

For attaining this object, the invention proposes a method for producing finished stacks by cutting relatively large rectangular starting stacks of a plurality of sheets transversely and longitudinally using a single cutting machine, wherein the method has the following features:

- the starting stack is arranged on a rear table of the cutting machine, and is pushed forward under a cutting blade of the cutting machine at least once by a pushing tool arranged in the area of the rear table, and the starting stack is separated into multiple partial stacks;

a pushing tool pushes the multiple partial stacks back under the cutting blade;

the multiple partial stacks are aligned on the rear table to create a rectangular full stack; and the full stack is pushed forward under the cutting blade at least once, and the full stack is separated into a plurality of partial stacks;

the multiple partial stacks are rotated after the starting stack is separated into the multiple partial stacks and before the full stack is pushed forward to create the plurality of partial stacks, so that these multiple partial stacks are positioned perpendicular to their start position, the plurality of partial stacks created during these cuts are removed onto a receiving table arranged to the side of the cutting machine, and the plurality of partial stacks are aligned to create a rectangular full stack.

It is considered particularly advantageous when the starting stack is first edge-trimmed, so that an edge-trimmed, rectangular starting stack is separated into multiple partial stacks.

In the context of the present invention, it is enough if the stack is cut only once transversely and only once longitudinally, with two rectangular full stacks being created with the first cut and four full utility stacks being created from these two full stacks with the second cut. As a rule, however, there are more cuts, at least one transverse cut and two longitudinal cuts, for creating six partial stacks.

In accordance with one preferred refinement of the method, it is provided that the multiple partial stacks created when the starting stack is cut are transferred onto a rotary plate arranged in front of the rear table. The rotary plate rotates the multiple partial stacks disposed or arranged on the rotary plate about the aforesaid angle, so that these partial stacks are positioned on the rotary plate perpendicular to their initial start position. The multiple partial stacks arranged on the rotary plate are furthermore transferred onto the rear table, and the partial stacks are aligned for creating the rectangular full stack.

Once the starting stack has been separated into the multiple partial stacks and moved from the rear table to the rotary plate, and once the rotary plate has rotated these multiple partial stacks, especially 90 degrees, the multiple partial stacks that have been created are returned to the rear table in the opposite direction. After these partial stacks have been aligned to create the rectangular full stack, they are cut multiple times again to produce the plurality of partial stacks. The cutting machine can be made as a composite machine, so that the rotary plate is a component of the cutting machine, and the cutting machine can be configured to be very compact because of the very short travel paths for the material being cut. The desired partial stacks can be produced in a relatively short period of time as a result of the short paths the material travels. Therefore, the compact configuration makes it possible to produce an apparatus for performing the method in a cost-effective manner.

Thus, the cutting machine is provided with a rear table, which as seen from the rotary plate, is arranged immediately behind the cutting blade cutting plane of the cutting machine. The rotary plate is positioned or arranged on the side of the rear table that faces away from the cutting plane, that is, in front of the rear table. The rotary plate may be configured in a number of different ways. The rotary plate preferably has a circular surface for receiving the cut material, and is inset in a rectangular front table that accommodates the central rotary plate. The receiving surface of the front table and that of the rotary plate are in the same plane. A mechanism for raising slightly the rotary plate is provided in case the cut material to be rotated by the rotary plate projects slightly beyond the rotary plate. After the rotary plate has been raised, it is rotated 90 degrees or 270 degrees. Then, it is lowered back to its initial level, so that the surface of the rotary plate is in the same plane as the surface of the front table. Moreover, it is also possible for the rotary plate to be configured as a rectangular table that is initially moved away from the rear table after the multiple partial stacks have been received thereon. This way, there is enough space for the rotary plate to be rotated. Then, the rotary plate is preferably rotated 90 degrees, and moved back toward the rear table, closing the gap between the rotary plate and the rear table. The multiple partial stacks can then be conveyed from the rotary plate to the rear table to further cut the multiple partial stacks, and create the plurality of partial stacks. Finally, it is entirely possible for a front table to be arranged between the rotary plate and the rear table. In this case, the rotary plate is only used when the multiple partial stacks are to be rotated. Otherwise, if it is enough only to produce the multiple partial stacks, they are transferred to the front table and removed to the side without the rotary plate being used.

The rotary plate can be rotated either clockwise or counterclockwise. The direction of rotation is, in particular, a function of the manner in which the stacked material is processed.

The multiple partial stacks that are created with the cuts are, in particular, transferred in succession to the rotary plate arranged in front of the rear table. The same are transferred to the rotary plate, so that the multiple partial stacks create a rectangular full stack. This can happen in that each partial stack is aligned on a straight edge associated with the front table, as is described for EP 0 056 874 A2.

The multiple partial stacks that have been transferred onto the rear table from the rotary plate are preferably aligned using a back gauge that is commonly used with a cutting machine, and using a lateral stop on the cutting machine that is arranged perpendicular to the back gauge. The back gauge pushes the material to be cut forward under the cutting blade so that it can cut the material.

In accordance with another preferred embodiment of the inventive method, the multiple partial stacks are rotated on a rear table, or on a front table of the cutting machine. Especially, the rectangular full stack created from the multiple partial stacks is rotated on the back table. This rotation is performed especially by a rotary gripper that is arranged on the front table or the rear table above the contact plane of the partial stack. The rotary gripper is, in particular, disposed in the area of the rear table, and rotates the rectangular full stack, thus rotating the multiple partial stacks after their rectangular alignment. If the material is rotated with the full stack in its rectangular orientation, this full stack is arranged exactly after the rotation, and can immediately be supplied to the next cutting process by the back gauge. In this alternative method, the cutting machine can also be configured to be very compact because of the very short travel paths for the material to be cut. As a result, the desired partial stacks can be produced in a relatively short period of time because of the short travel paths for the material. It is possible to produce an apparatus for performing the method in a cost effective manner because of this compact design.

In the context of what has been described in the foregoing, it is certainly possible to make intermediate cuts between the utility cuts and to dispose of strips of waste that occur as a result of these intermediate cuts. To this end, the cutting machine is especially embodied in the manner described, having the rear table and the front table. These tables can be moved apart to create a gap for waste disposal, and can then be closed together again.

In particular, all of the conveying processes for the material to be cut are advantageously accomplished by pushing the material to be cut, whether this is the starting stack, the multiple partial stacks, or the finished partial stacks. However, it is also fundamentally possible to use grippers that grip and transport the material to be cut.

The multiple partial stacks and the plurality of finished or partial stacks produced subsequently are preferably pushed in the same direction. This design contributes to having short push paths for the material to be cut, and thus contributes to the compact nature of the cutting machine, and to a total system that includes the cutting machine, as well as the peripheral equipment for further processing the cut material.

In terms of handling the material to be cut, it is considered particularly advantageous when, after the starting stack has been separated into the plurality of partial stacks, all of the partial stacks are arranged on the rotary plate or the front table, and the arrangement of the plurality of finished stacks is entirely removed onto the side receiving table. The plurality of partial stacks for creating the rectangular full utility stack is, in particular, aligned in the area of the receiving table. Alignment stops that are preferably arranged at right angles to one another are allocated to the receiving table. Their stop surfaces, which are arranged perpendicular to one another, are positioned perpendicular to the receiving surface of the receiving table.

Furthermore, it is possible for the partial stacks created by the multiple partial stacks and/or the full stack or full utility stack created from various series of partial stacks to be aligned between stops that are disposed parallel to the direction of transfer. It may be possible to move these stops toward one another, and it also may be possible to raise and lower them.

With respect to further processing of the full utility stack, it is considered particularly advantageous for the full finished stack to be pushed from the receiving table onto a movable receiving table. From the movable receiving table, the full finished stack is stacked onto a pallet or onto other full finished stacks that have already been created and stacked on the pallet.

The inventive method makes it possible to operate the cutting process with a single, one blade cutting machine, and to make optimum use of the cutting machine. Thus, it is especially provided that, after the full stack has been separated into the plurality of partial stacks, another starting stack is immediately fed to the rear table of the cutting machine, and the starting stack is pushed at least once for separating the starting stack into multiple partial stacks. Consequently, immediately after the first starting stack has been processed, a second starting stack is supplied to the rear table of the cutting machine so that, if necessary, its edges can be trimmed, and it can be further processed to create the full stack and then the full finished stack.

Additional features of the present invention are depicted in the description of the following figures and in the subordinate claims. All individual features, and all combinations of individual features, are portions of the invention.

These and other advantages of the invention will be further understood and appreciated by those skilled in the art by reference to the following written specification, claims and appended drawings.

BRIEF DESCRIPTION OF THE DRAWINGS

FIGS. 1 through 8 depict one apparatus variant, and FIGS. 9 through 19 depict the other apparatus variant.

FIGS. 1 through 8 provide a top view onto a system for feeding large initial stacks to a cutting machine. Further depicted are a rotary plate that cooperates with the cutting machine, and a device for removing a rectangular full finished stack created after the cutting processes.

DETAILED DESCRIPTION OF THE PREFERRED EMBODIMENTS

Figure 1:
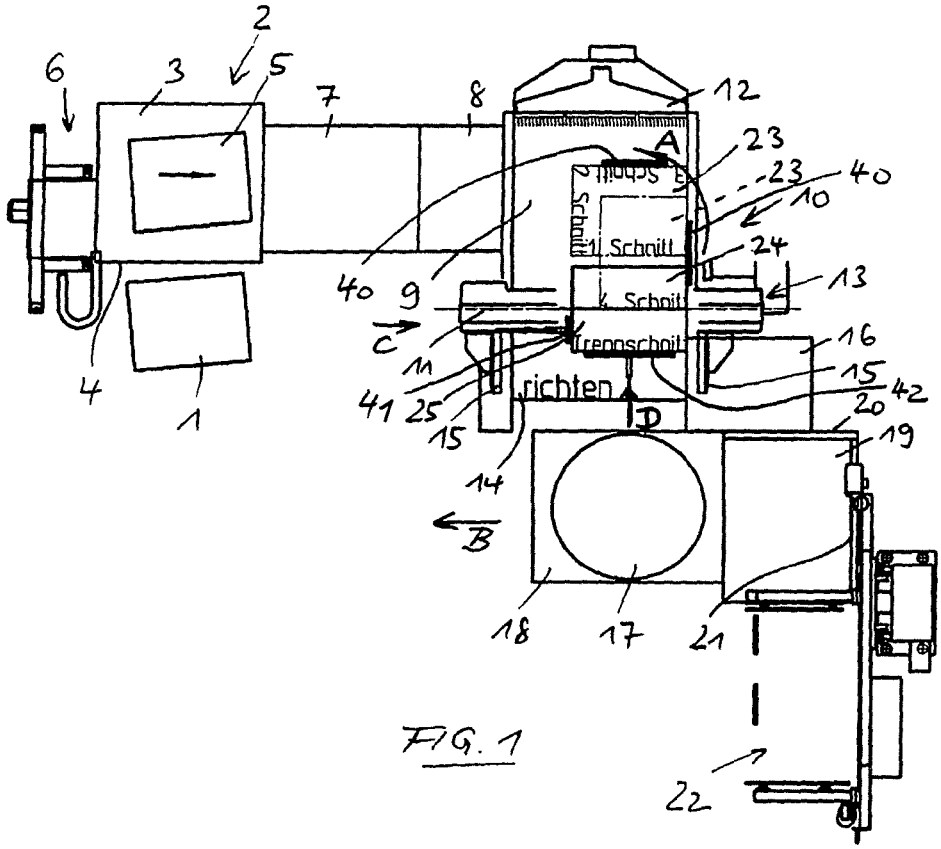
FIGS. 1 through 19 depict two inventive method variants using two advantageous apparatus variants.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Refer to the depiction in FIG. 1 for the basic configuration of the system for performing the first method variant.

FIG. 1 depicts a rectangularly-shaped stack 1 of relatively large, individually printed sheets that have been produced by a printer, such as a sheet-fed printer, and stacked vertically on a pallet (not shown). An upper portion of the stack 1 is transferred by a removal apparatus 2, which has a table 3 that can be positioned at a defined height. The table 3 has a drivable transfer roller 4 in the area of its front edge, which moves laterally into the stack 1 that is arranged at an angle to and in front of the transfer roller 4. Transfer roller 4 thus positions an upper portion of the stack 1 on the table 3, which portion is referred to herein as an initial stack or starting stack 5. A pushing device 6 transfers the starting stack 5 to a rear table 9 on the cutting machine 10 via tables 7 and 8, which are disposed adjacent to the table 3.

The cutting machine 10 has a back gauge 12 in the area of rear table 9. The back gauge 12 can be moved back and forth toward the cutting plane 11 of the cutting machine 10. The back gauge 12 is depicted in its most retracted position in FIG. 1. A front table 14 for the cutting machine 10 is disposed in front of the rear table 9. The rear table 9 receives the material to be cut. The front table 14 receives the cut sheet material. A clamp for clamping the sheet material to be cut on the rear table 9 is located in a frame 13 portion of the cutting machine 10. The cutting blade for cutting the sheet material is also arranged in the frame 13 in front of the clamp. The front table 14 and the rear table 9 can be moved or shifted away from one another adjacent to the cutting plane 11 in order to create a gap therebetween, so that strips of waste produced during an intermediate cut can be disposed of through the gap. Then the gap is closed again.

A rotary gripper is supported on the frame 13 on the side facing the rear table 9 and can be pivoted about a vertical axis. The rotary gripper is depicted only in terms of its gripper element 40, which actually grips the stack. Two gripper positions for the gripper element 40 are shown, specifically a first position in which the gripper element 40 grips the side of the stack 23 and pivots it 90 degrees, following the arrow A, into its second depicted position.

Light cabinets are labeled 15. They ensure that an operator who is working with the cutting machine 10 in the area of the front table 14 cannot reach into the cutting area when the cutting blade is operating.

A side table 16 is arranged adjacent to the cutting machine 10, which has been described and is known from the prior art. Specifically, the side table 16 is arranged adjacent to the front table 14. Cut sheet material can be placed on the side table 16 in the event that the rotary plate that is used in the inventive method variant, as discussed below, is not used. The side table 16 is positioned immediately adjacent to the front table 14.

The illustrated cutting system has a circular rotary plate 17 that can be rotated and raised and lowered relative to another table 18 using conventional means (not shown). The table 18 has a rectangular contour when viewed from the top, wherein the long sides of the table 18 run parallel to the cutting plane 11. The length of the short sides of the table is approximately equal to the diameter of the rotary plate 17, which is located symmetrically in the table 18.

Figure 8:
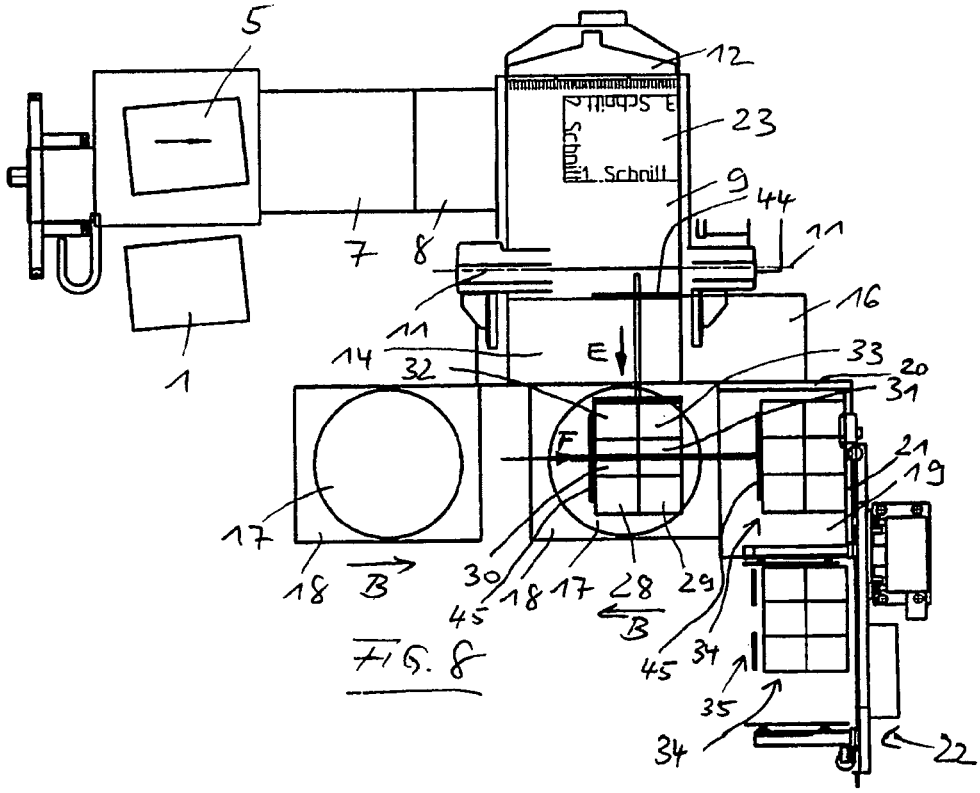

As can be seen in the depiction in FIG. 8, the table 18 can be moved laterally in the direction of the arrow B between a working position on the right, and a parked position on the left. The table 18 with the rotary plate 17 is positioned adjacent to the front table 14 when there is a gap formed between the front table 14 and the rear table 9, and thus the front table 14 has moved away from the rear table 9 perpendicular to the cutting plane. To shift to the parked position, the table 18 is moved in the direction of the arrow parallel to the cutting plane 11, away from a position against the front table 14, so that an operator can stand immediately next to the front table 14. There, the operator is able to handle the cut sheet material according to the specific purpose of the cutting machine 10. The table 18 is moved back out of its parked position into its working position in the direction of the other arrow B. The table 18, when in the working position, is located adjacent to another table 19 that has a rectangular surface. This table 19 has an alignment straight edge 20 on its side that faces the side table 16 and is parallel to the cutting plane 11. The straight edge 20 is positioned perpendicular to the surface of the table 19, and can be moved horizontally and vertically. Correspondingly, the table 19, on its longer side that faces away from the table 18, has an alignment straight edge 21 that can be moved horizontally and vertically. The table 19 receives a full finished stack, which will be explained below in greater detail. A stacking unit 22 is arranged adjacent to the table 19, and stacks the full finished stack onto a pallet, or onto another full finished stack that has the same dimensions and shape, and has already been stacked onto the pallet, so that the stacked full finished stack can be subsequently processed.

One inventive method embodying the present invention is explained in the following, using the illustrations in the figures.

The figures illustrate how two initial or starting stacks 5 are cut. In FIG. 1, the second starting stack 5 is located on the table 3, having been removed from the stack 1. In FIG. 1, the first starting stack 23 has already been edge cut or trimmed on its four vertically arranged sides, that is, on its edges. The captions "1st cut", "2nd cut", "3rd cut", and "4th cut" for the different rotary positions illustrate how the edges of starting stack 5 are trimmed using the rotary gripper that has the gripper element 40. Once the edges of the starting stack 5 have been trimmed, the edge-trimmed starting stack 23 is positioned in the area of the rear table 9 of the cutting machine 10. The back gauge 12 pushes this edge-trimmed starting stack 23 forward under the cutting blade, and a separating cut is made that divides the edge-trimmed starting stack 23 into two partial stacks 24, 25. After the cut, the partial stack 24 is located on the rear table 9, and the partial stack 25 is located on the front table 14. Where necessary, an intermediate cut can be made after the separating cut, as is described in EP 0 056 874 A2. More specifically, the front table 14 is moved away from the rear table 9 after the separating cut in order to create a gap. Then, the back gauge 12 moves the partial stack 24 forward slightly. The back gauge 12 is shown in its rear final position in all of the figures, regardless of its position for the method step. Then, the clamp clamps the partial stack 24, and the intermediate cut is made, so that the cut material waste that is created during this intermediate step is removed by falling through the gap. The front table 14 is then moved toward the rear table 9, and the partial stack 24 is conveyed onto the front table 14, such as by pushing the back gauge 12.

A lateral straight edge 41 supported on the frame 13 can be moved in the direction of the arrow C parallel to the cutting plane 11. A front straight edge 42 can be moved in the direction of the arrow D perpendicular to the cutting plane 11. FIG. 1 illustrates that after the separating cut, the partial stack 25 can be aligned by the lateral straight edge 41 and the front straight edge 42 in order to maintain the rectangular shape of the partial stack 25.

Figure 2:
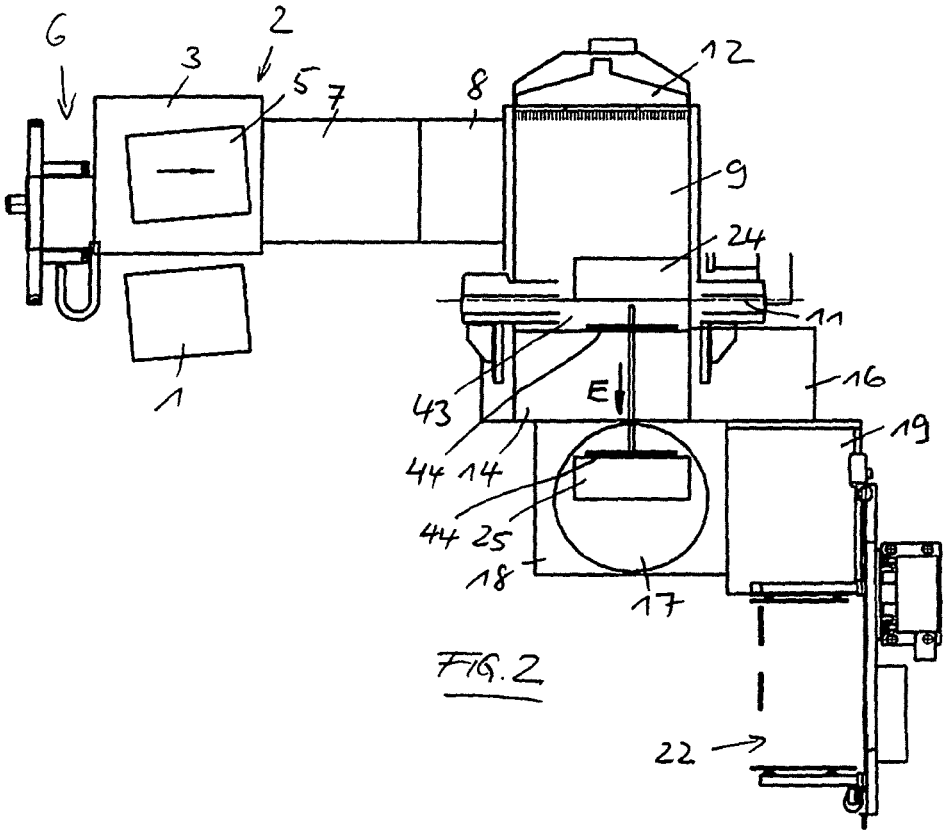
Figure 3:
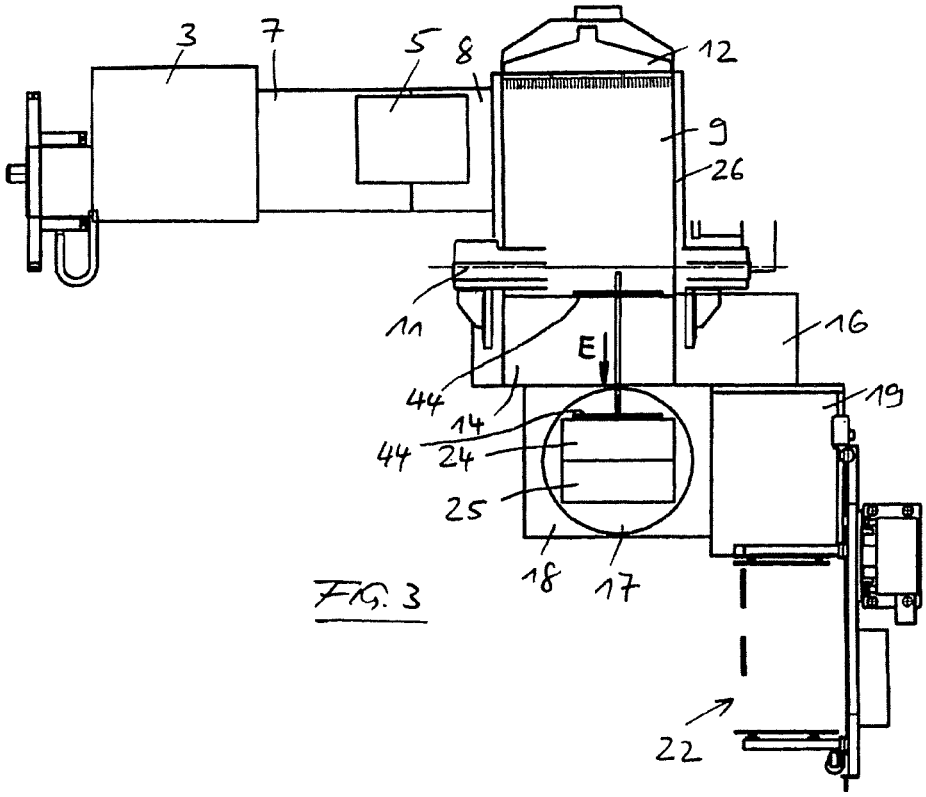

FIG. 2 illustrates the partial stack 25 having been conveyed onto the rotary plate 17 parallel to the cutting plane 11. The partial stack 25 is conveyed onto the rotary plate 17 by a pushing straight edge 44 that is arranged parallel to the cutting plane 11, and can move forward and back in the direction of the arrow E. The partial stack 25 is conveyed when the front table 14 has been moved away from the rear table 9, that is, when a gap 43 is created between the rear table 9 and the front table 14. FIG. 2 illustrates the pushing straight edge 44 in a first position in the area of the rear edge of the front table 14 and in a second position above the rotary plate 17. The partial stack 24 is correspondingly conveyed onto the rotary plate 17 in accordance with the illustrated arrow E, as can be seen in FIG. 3. At this point in time, the second starting stack 5 has already been conveyed toward the cutting machine 10 by the pushing device 6, and is positioned adjacent to the rear table 9.

Figure 4:
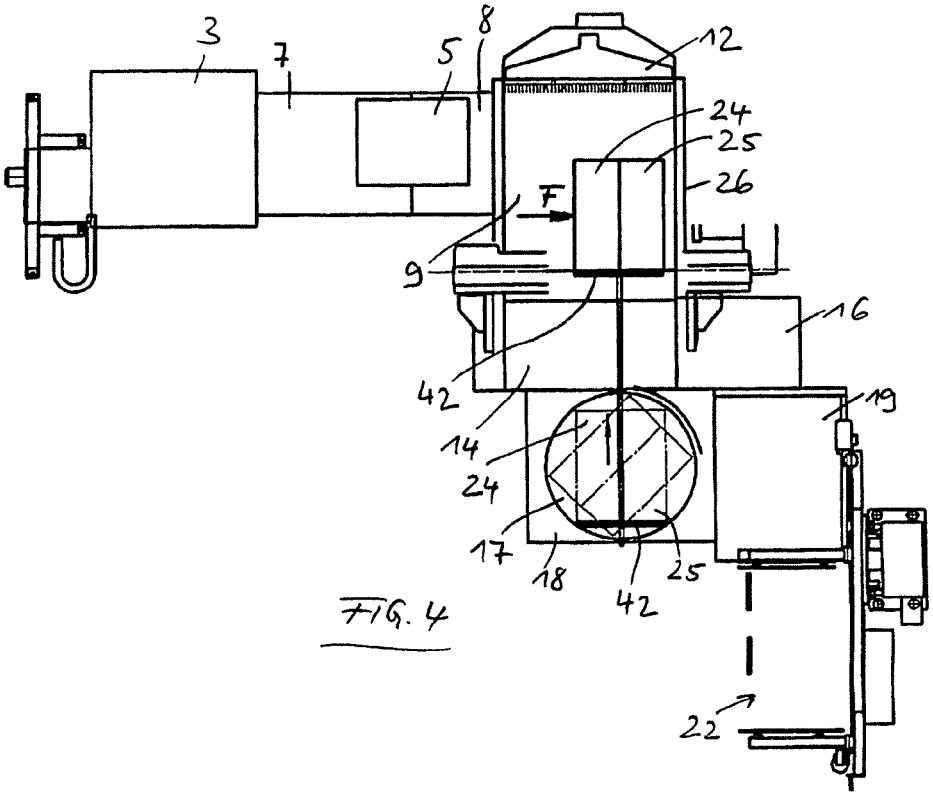

As can be seen in the depiction in FIG. 4, the rotary plate 17 is rotated 90 degrees about its vertical axis after the two partial stacks 24 and 25 have been transferred thereon, that is, after the multiple partial stacks created in accordance with the present invention are positioned on the rotary plate 17. FIG. 4 illustrates an intermediate rotated position, and the final rotated position for the two partial stacks 24 and 25. The partial stacks 24 and 25 are numbered only in the final position. Then, the front straight edge 42 returns partial stacks 24 and 25 disposed on the rotary plate 17 to the rear table 9 in the direction of the arrow D, which opposes the arrow E. Then, the two partial stacks 24 and 25 are aligned on the back gauge 12, and in the direction of the arrow F, on a lateral straight edge 41 of the cutting machine 10 that is arranged perpendicular to the cutting plane 11. Consequently, the two partial stacks 24 and 25 are disposed in a precisely aligned rectangular full stack 27.

Figure 5:
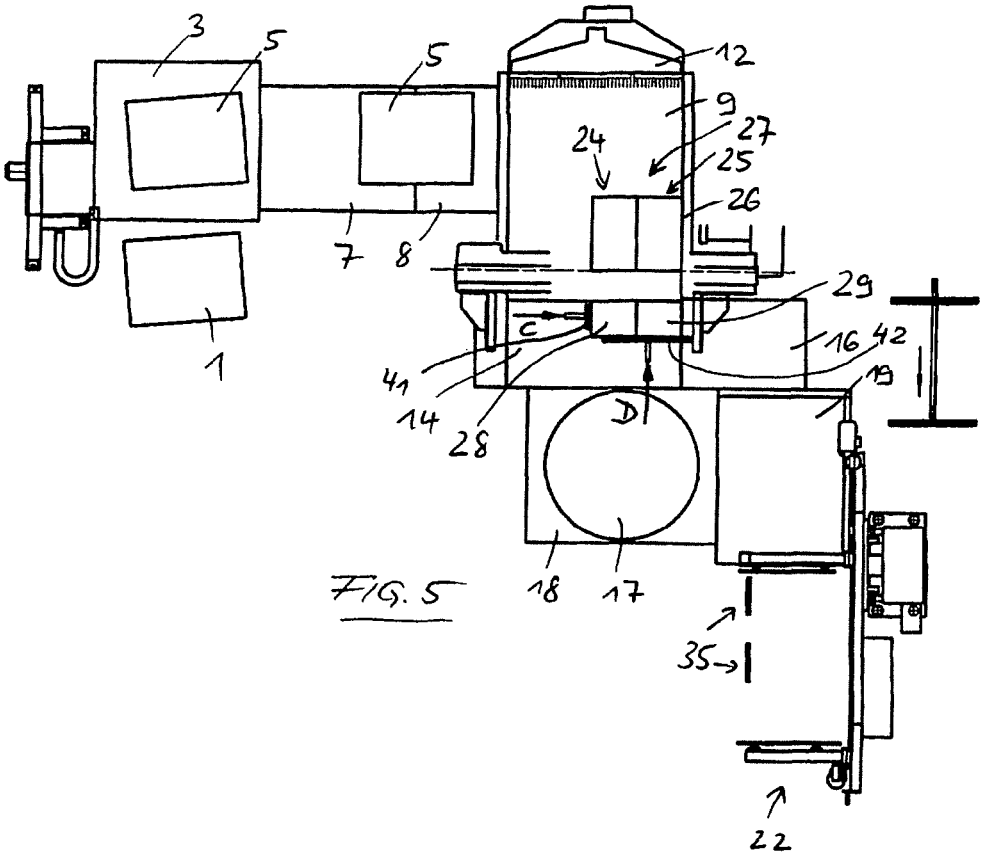
Figure 7:
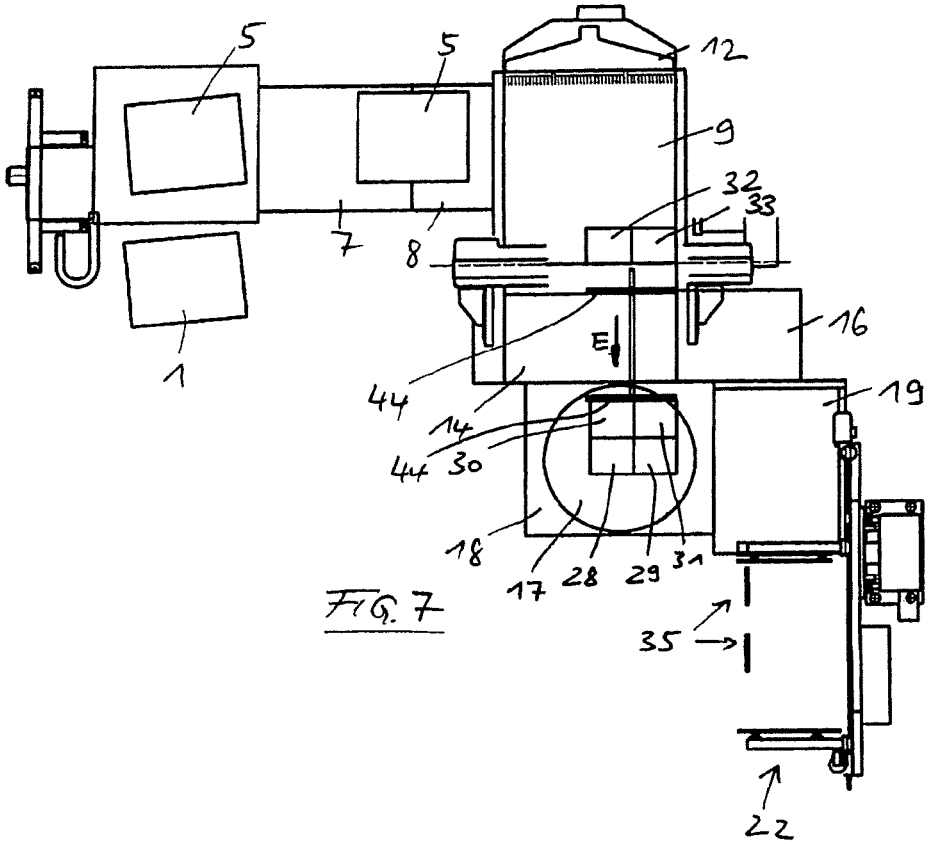

The back gauge 12 pushes the full stack 27 forward. FIG. 5 illustrates how the first cut is made in the full stack 27. Then, the two partial stacks 28 and 29 created with this cut are aligned using the straight edges 41 and 42. The straight edge 44 pushes the full stack 27 further towards the front table 14 onto the rotary plate 17, and the second cut is made in the full stack 27, with the partial stacks 30 and 31 being aligned and pushed onto the rotary plate 17. As can be seen in FIG. 7, six partial stacks 28, 29, 30, 31, 32, and 33 are created due to the two cuts. These six partial stacks create the plurality of finished partial stacks in the terminology of the present application.

Figure 6:
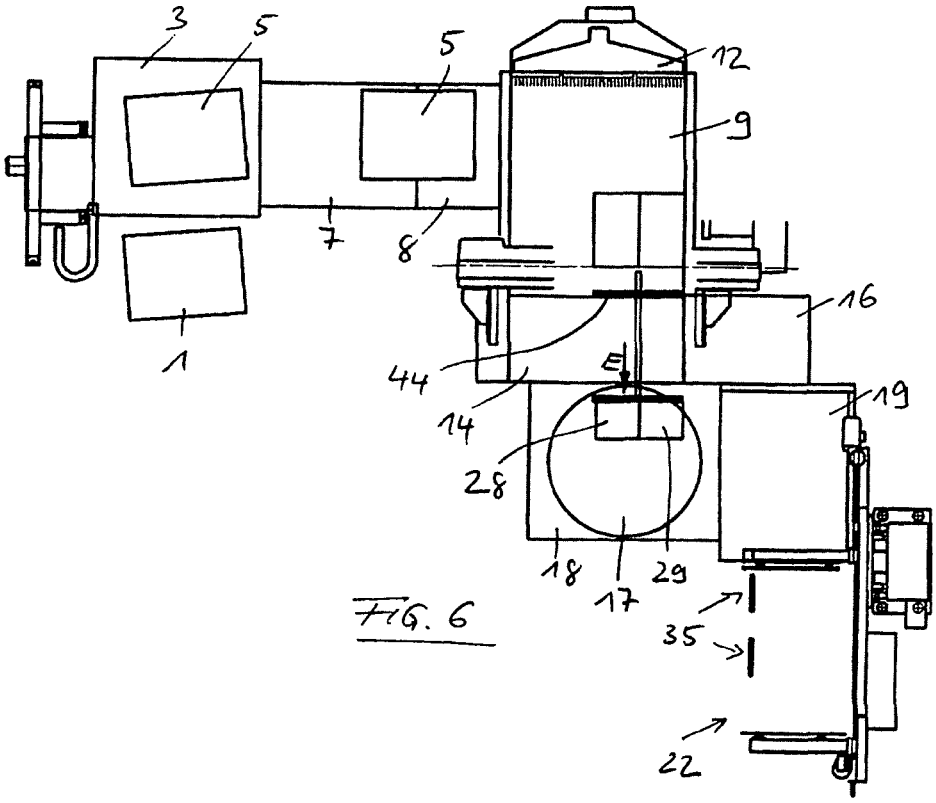

FIG. 6 illustrates that the partial stacks 28 and 29 that were initially created are already being conveyed in the direction of the arrow E onto the rotary plate 17. FIG. 7 depicts the partial stacks 30 and 31 that were created with the additional cut and that have also been conveyed onto the rotary plate 17. They have pushed the partial stacks 28 and 29 that were created first further onto the rotary plate 17. When the straight edge 44 pushes the partial stacks 32 and 33, the partial stacks 28 through 31 are pushed further onto the rotary plate 17 by the partial stacks 32 and 33, as can be seen in FIG. 8.

As soon as the back gauge 12 is returned to its most retracted position after the partial stacks 28 through 33 have been cut, the starting stack 5 arranged adjacent to the rear table 9 is pushed onto the rear table 9 and the edges are trimmed as described in the foregoing. A new starting stack 5 is simultaneously removed from the stack 1. The second edge-trimmed starting stack 23 disposed on the rear table 9 is then divided as described in the foregoing, first into the unfinished or intermediate partial stacks 24 and 25, and then into the finished partial stacks 28 through 33.

With respect to the illustration in FIG. 8, a lateral straight edge transfers the six partial stacks 28 through 33 disposed on the rotary plate 17 to the table 19, which is located adjacent to the table 18, in accordance with the arrow F. The lateral straight edge 44 is arranged perpendicular to the cutting plane 11, and can be moved parallel to the cutting plane 11 (and is again depicted in two positions). The six finished partial stacks 28 through 33 are then aligned on the alignment straight edges 20 and 21, so that the result is a precisely rectangular full finished stack 34 created from the six finished partial stacks 28 through 33. The stacking unit 22 stacks this full finished stack 34 located on the table 19 onto the pallet 35, or onto another full utility stack 34 that was previously produced and stacked on the pallet 35.

During this stacking process, the edge-trimmed starting stack 23 resting on the front table 14 and on the rear table 9 of the cutting machine 10 is cut to produce the two partial stacks 28 and 30. Thus, the cutting and removing process continues in accordance with described FIGS. 1 through 8.

The finished partial stacks 28 through 33 are illustrated in three different positions in FIG. 8, solely for the purpose of better understanding. They are illustrated on the rotary plate 17, on the table 19, and on the pallet 35. In actuality, the finished partial stacks 28 through 33 are disposed either on the rotary plate 17, on the table 19, on the pallet 35, or on a full utility stack 34 that was previously placed on the pallet 35.

FIGS. 9 through 19 depict a system for performing the second inventive method embodying the present invention. This system has been slightly modified compared to the system in accordance with FIGS. 1 through 8. For the sake of simplicity, the same reference numbers are used for apparatus features in the variant illustrated in FIGS. 9 through 19 that are used for apparatus features in the variant illustrated in FIGS. 1 through 8.

In the following, only those features for the second apparatus variant or second method variant that differ from those for the first apparatus variant or method variant in accordance with FIGS. 1 through 8 are described in detail.

The variant or embodiment illustrated in FIGS. 9 through 19 differs from the variant or embodiment illustrated in FIGS. 1 through 8 in that the apparatus does not have a table 18 with a rotary plate 17, and the table 19 is arranged adjacent to the table 16, not in front of the table 16. As a result, all of the partial stacks 28 through 33 are not transferred or removed together. Instead, pairs of partial stacks are transferred in cycles, wherein first the partial stacks 28 and 29 are transferred, then the partial stacks 30 and 31, and finally the partial stacks 32 and 33. The partial stacks 28 through 33 are removed by the lateral straight edge 41 after the respective stack pair has been aligned on the front straight edge 42.

Since there is no rotary plate 17, after the two partial stacks 24 and 25 are pushed back onto the rear table 9 by the front straight edge 42, they are rotated when they are gripped by the aforesaid rotary gripper, specifically the gripper element 40, as described in the foregoing. The rear table 9 can be moved horizontally and vertically, so that the partial stacks 28 through 33 can be pushed in a removal or transfer direction parallel to the cutting plane across the table 16 onto the table 19. Using the table 19, the full finished stack 34 disposed on the table 19 can be stacked on the pallet 35 by the stacking unit 22, or can be stacked on a full finished stack 34 that was previously created and stacked on the pallet 35.

Figure 9:
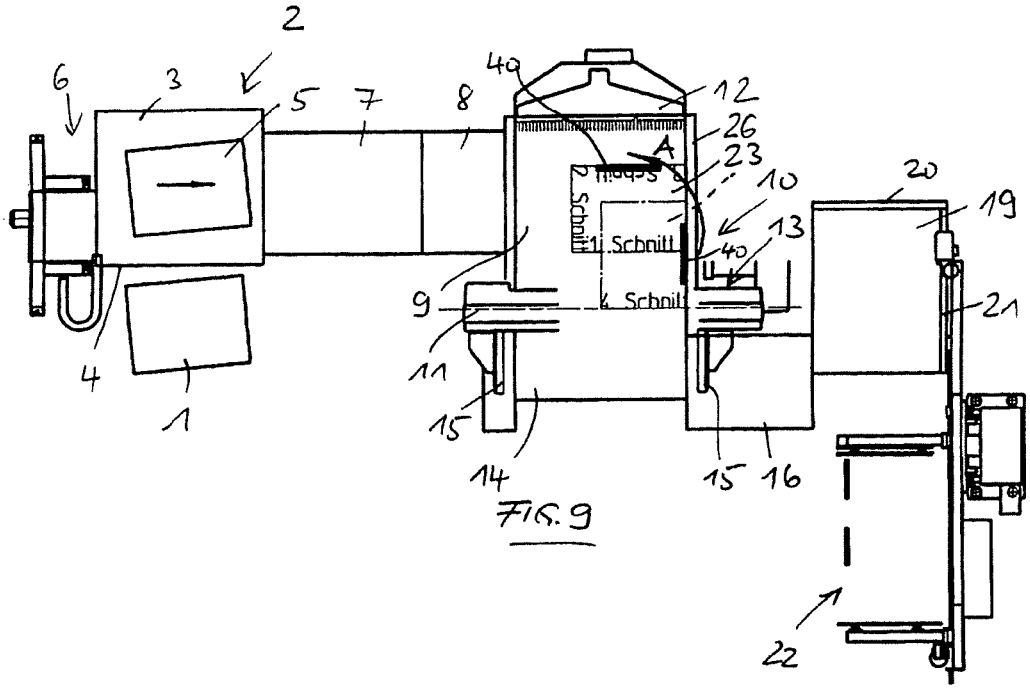

FIG. 9 illustrates in detail how the starting stack 5 is moved onto the rear table 9 of the cutting machine 10, and how this starting stack 5 is trimmed on its four edges. The rotary gripper 40 rotates the starting stack 5 about a vertical axis in order to position the starting stack. The edge-trimmed starting stack 23 is formed after the edges of the starting stack 5 have been trimmed.

Figure 10:
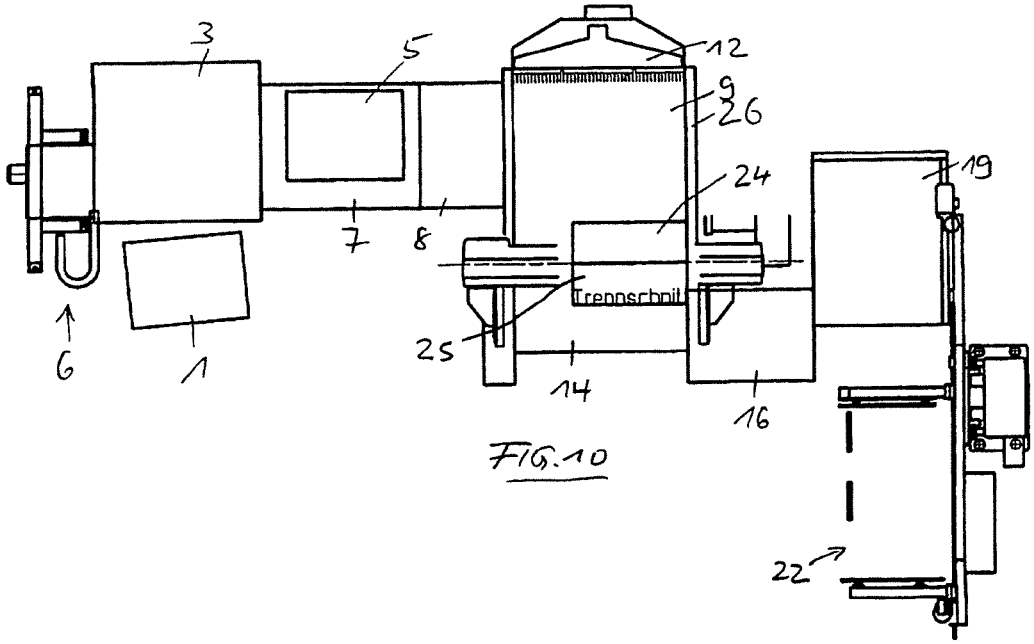

FIG. 10 depicts the starting stack 23 after it has been separated into two partial stacks 24 and 25.

Figure 11:
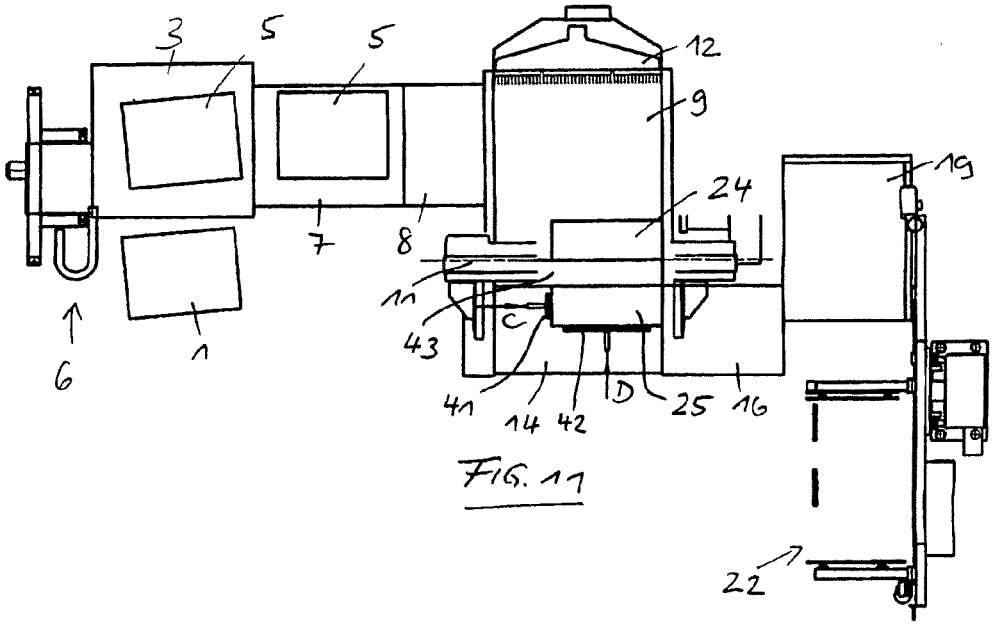

FIG. 11 clarifies that the front table 14 is moved away from the rear table 9 after the separating cut illustrated in FIG. 10 so that a gap 43 is created between these two tables 9, 14. The partial stack 25 is aligned in the manner illustrated in FIG. 11 by the lateral straight edge 41 and the front straight edge 42. An intermediate cut, like that described for EP 0 056 874 A1, may be added when the gap 43 is open.

Figure 12:
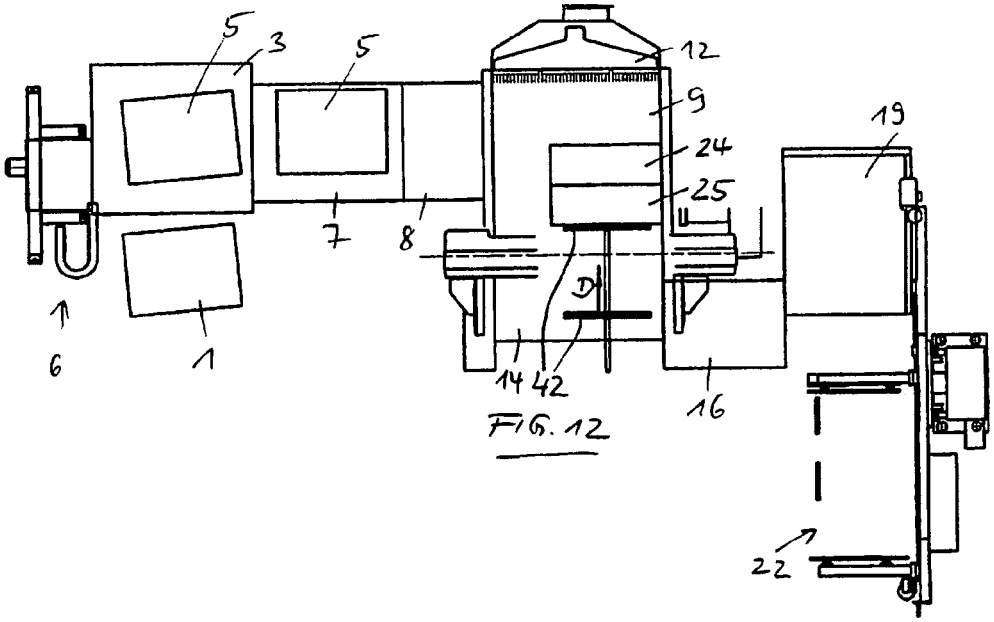

FIG. 12 illustrates the transfer or return of the two partial stacks 24 and 25 to rear table 9 after the gap 43 has been closed. The front straight edge 42 shifts the two partial stacks 24 and 25 away from the front table 14 toward the area of the gripper element 40.

Figure 13:
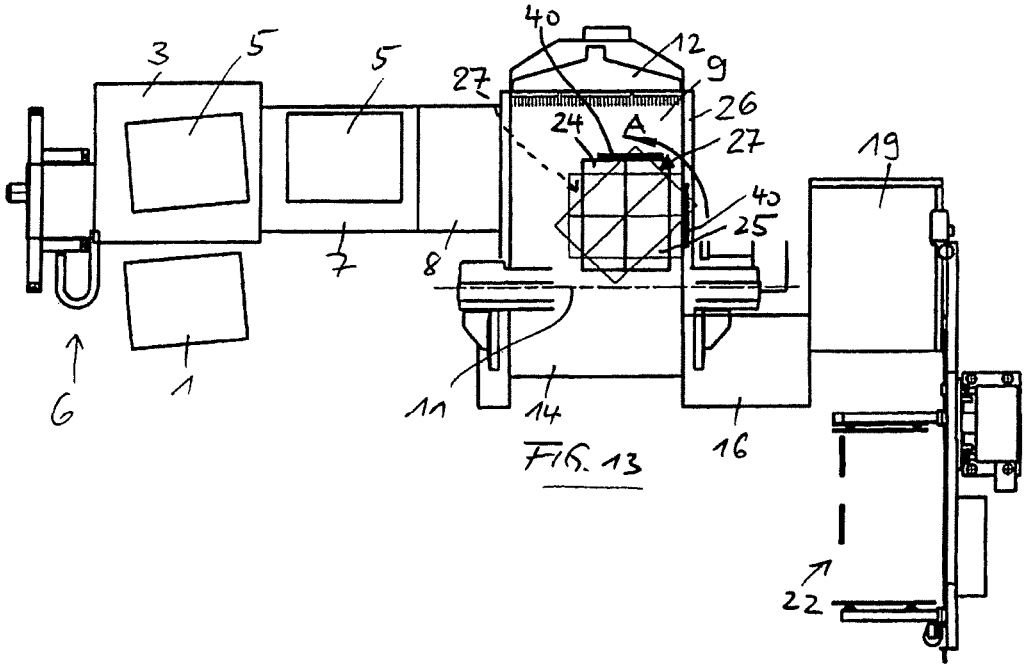

Then, the stack arrangement that has been created by the partial stacks 24 and 25 is rotated 90 degrees by gripper element 40, as shown in FIG. 13, so that the separating plane between the two partial stacks 24 and 25 is positioned perpendicular to the cutting plane 11.

Figure 14:
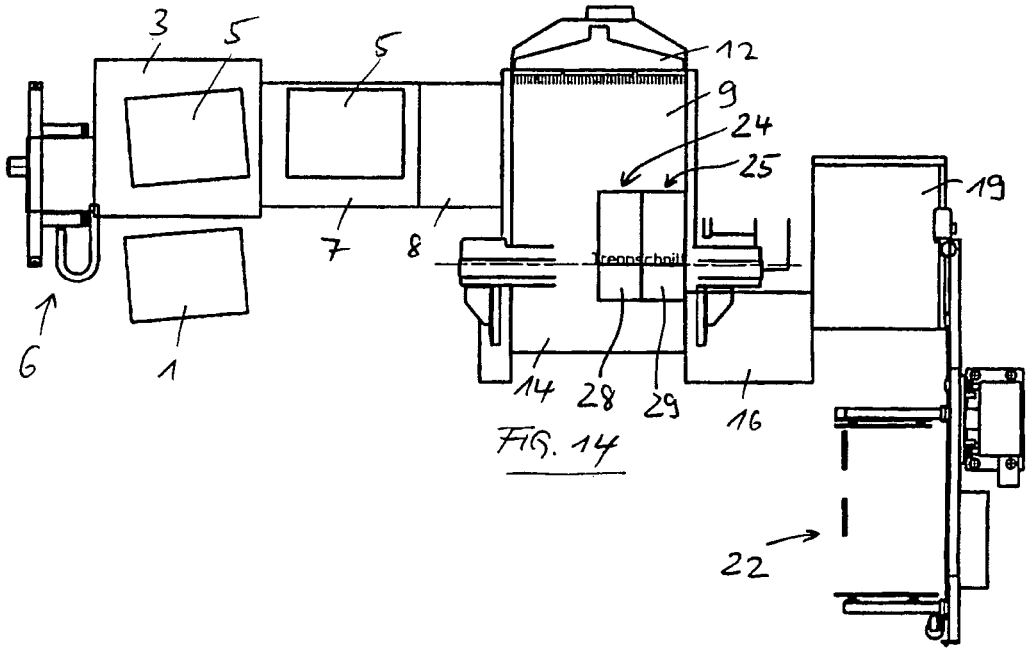

Then, the back gauge 12 pushes the two partial stacks 28 and 29 forward, as shown in FIG. 14, and the first separating cut creates the partial stacks 28 and 29.

Figure 15:
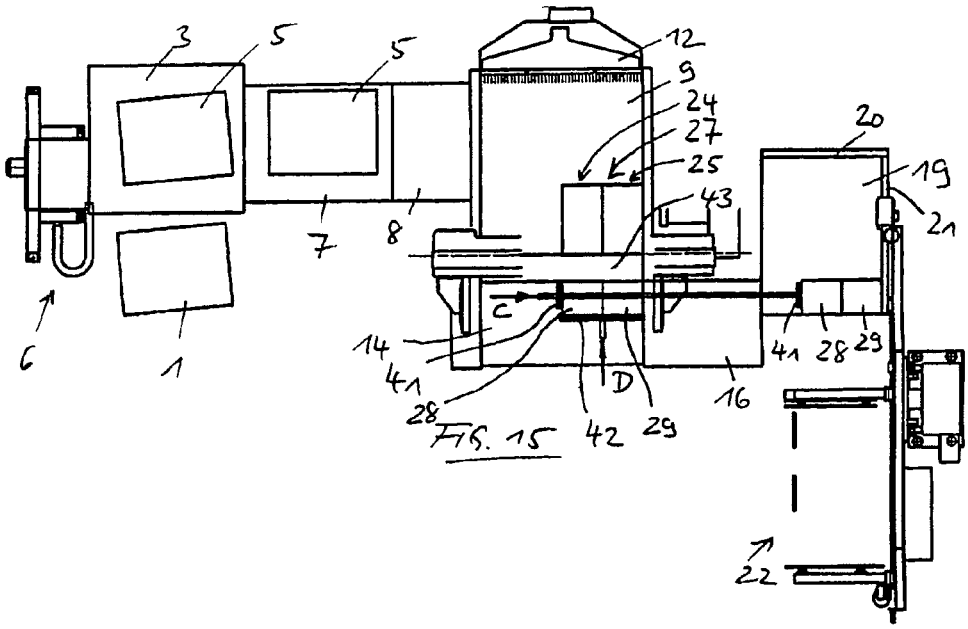

FIG. 15 illustrates that the gap 43 between rear table 9 and front table 14 is reopened after this separating cut. The stack pair created by the two partial stacks 28 and 29 is aligned on the straight edges 41 and 42. Then, the straight edge 41 moves this stack pair 28, 29 across the table 16 onto the table 19. The stack pair 28, 29 is aligned on the straight edge 41 of the table 19.

Figure 16:
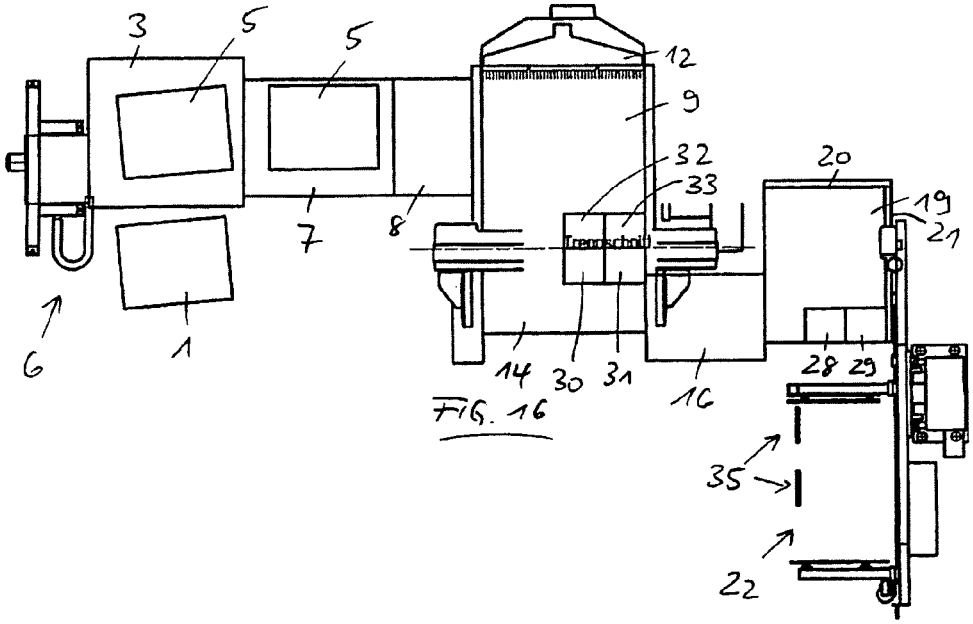

The gap 43 is closed, and then back gauge 12 moves the stack arrangement on the rear table 9 and front table 14 forward. Another separating cut is made, creating the partial stacks 30 through 33. The partial stacks 30 and 31 constitute one partial stack pair, and partial stacks 32 and 33 constitute another partial stack pair. FIG. 16 illustrates the situation after this separating cut.

Figure 17:
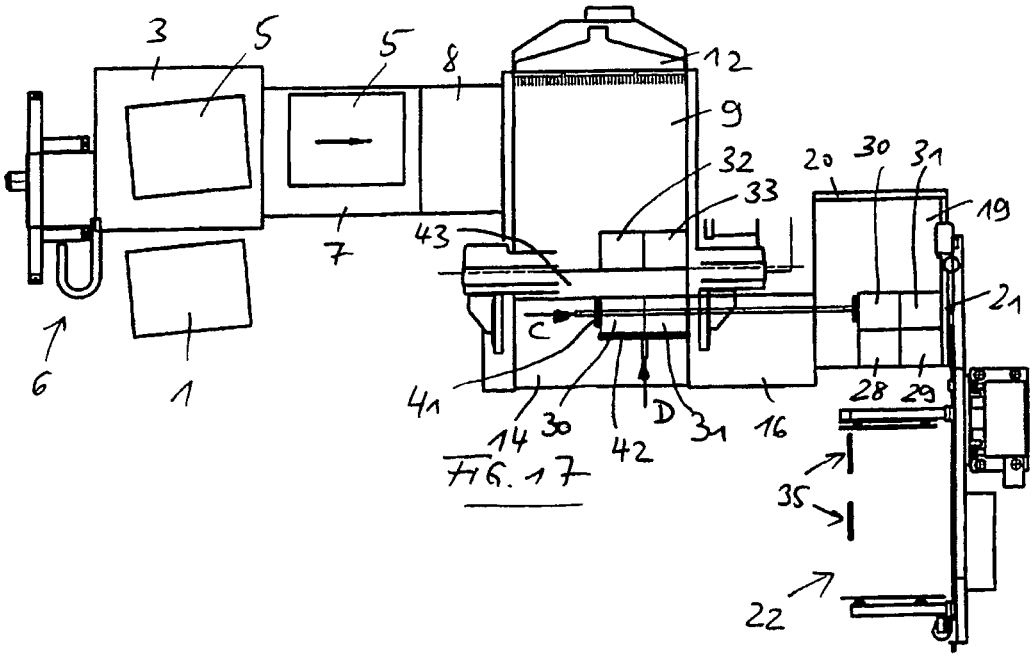

FIG. 17 illustrates that the gap 43 is reopened, and then partial stacks 30 and 31 are aligned on the straight edge 42. The straight edge 41 pushes the partial stack pair created by the partial stacks 30 and 31 across the table 16 onto the table 19. Prior to this transfer, the table 19 has been moved toward the stacking unit 22, so that when the partial stacks 30 and 31 are pushed onto the table 19, they are positioned immediately adjacent to the partial stacks 28 and 29.

Figure 18:
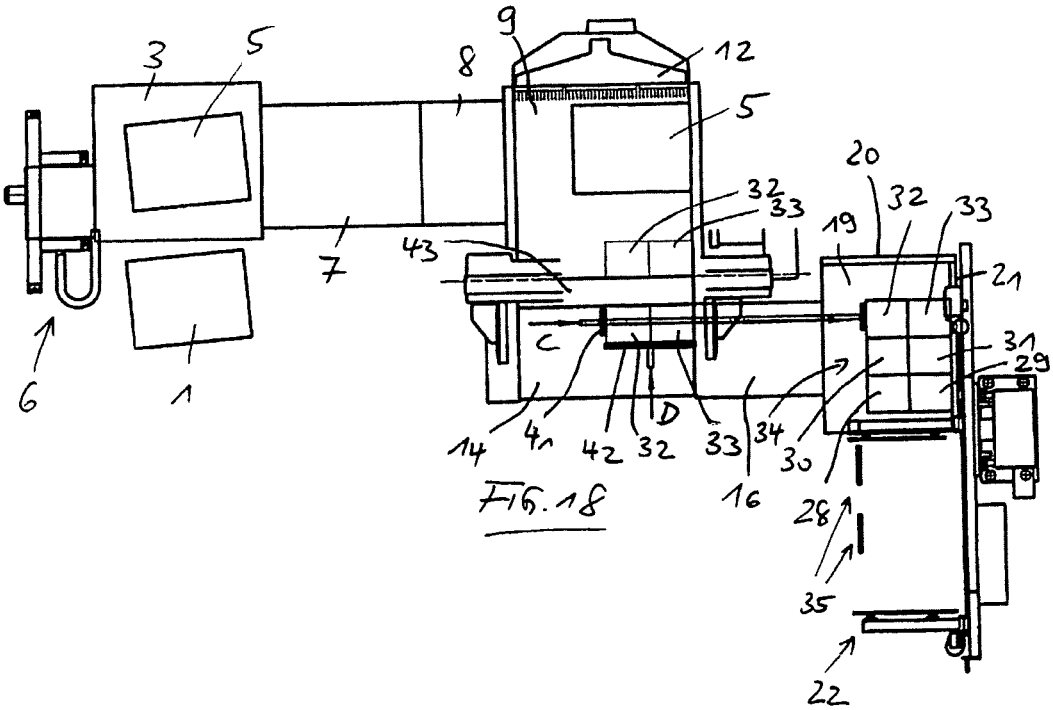
Figure 19:
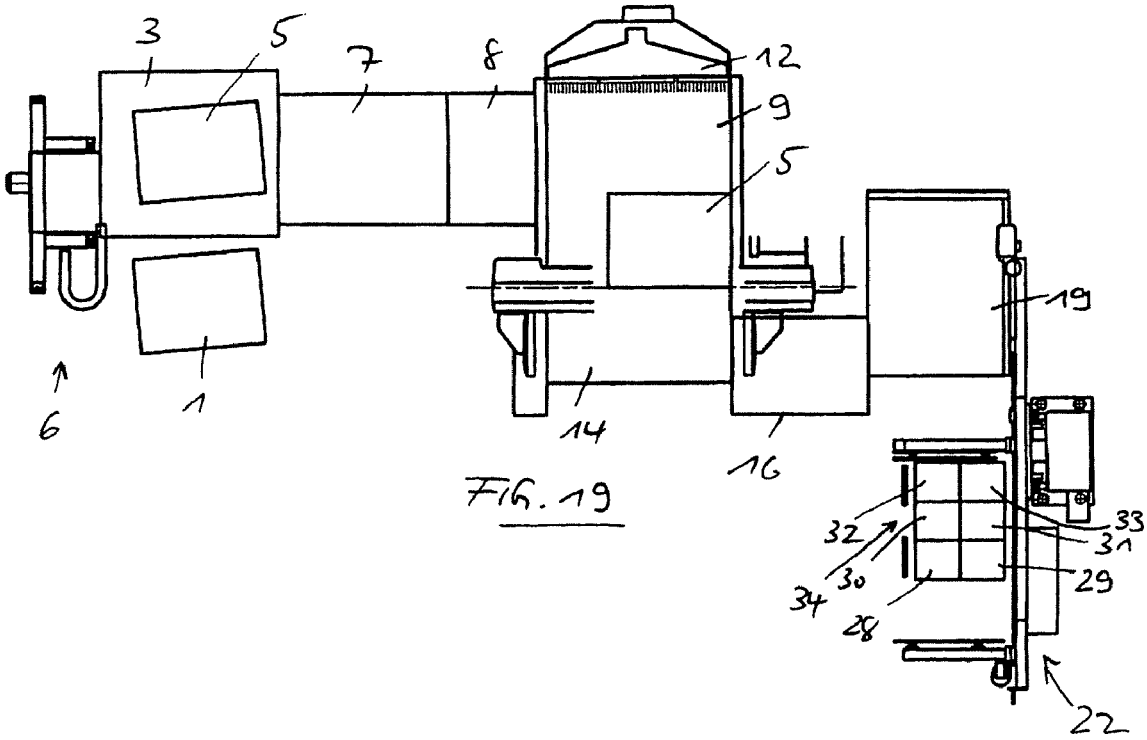

The gap 43 is closed, and then the partial stack pair formed from the partial stacks 32 and 33 is pushed onto the front table 14 by the back gauge 12 and is aligned there on the straight edge 42. The straight edge 41 pushes partial stacks 32, 33 across the table 16 onto the table 19. The table 19 was first moved further toward the stacking unit 22, so that the partial stacks 32 and 33 are positioned immediately adjacent to the partial stacks 30 and 31. As soon as the partial stacks 32 and 33 have been pushed onto the front table 14, the back gauge 12 returns to its start position, and the next starting stack 5 with edges to be trimmed is supplied to the rear table, so that it can be processed in a new cutting cycle as discussed below. FIG. 18 illustrates this situation.

The six partial stacks 28 through 33 are arranged on the table 19. Then, the table 19 is positioned slightly above the pallet 35, or above a full finished stack 34 that has already been stacked on the pallet 35. The full finished stack 34 on the table 19 is then stacked by the stacking unit 22.

In the figures for the two embodiments of the present invention, to facilitate the description above, the same parts are shown multiple times in the same figure in order to illustrate how the method progresses with the different positions for various parts.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A method for transversely and longitudinally cutting a relatively large rectangularly shaped starting stack of sheet material into a plurality of smaller finished partial stacks, using a cutting machine having a single cutting blade, comprising:

providing at least one table portion of the cutting machine having an upper support surface configured to facilitate sliding both the starting stack and the finished partial stacks on and across the upper surface of the table portion;

operatively supporting the cutting blade generally above and across the upper support surface of the table portion along a cutting plane;

positioning a starting stack of sheet material on the upper support surface of the table portion of the cutting machine;

providing a first pushing tool at a location operatively adjacent to the table portion of the cutting machine, and being configured to abuttingly engage at least a first side of either the starting stack and/or the finished partial stacks, and slidingly move the same forwardly along a straight line across the upper surface of the table portion in a first direction that is generally perpendicular to the cutting plane;

pushing the starting stack forwardly in said first direction slidingly across the upper support surface of the table portion to a position directly under the cutting blade portion of the cutting machine using the first pushing tool;

separating the starting stack into first and second partial stacks using the cutting blade;

providing a second pushing tool at a location operatively adjacent to the table portion of the cutting machine, and being configured to abuttingly engage at least a second side of the first and second partial stacks, which second side is oriented generally opposite to the first side of the starting stack, and slidingly move the first and second partial stacks along a straight line across the upper support surface of the table portion in a second direction that is generally perpendicular to the cutting plane and is opposite to the first direction;

pushing the first and second partial stacks on the upper support surface of the table portion slidingly rearwardly back under and past the cutting blade using the second pushing tool;

aligning the first and second partial stacks on the table to create a rectangular full stack disposed in a first full stack orientation on the upper support surface of the table portion of the cutting machine;

rotating the rectangular full stack in a generally horizontal plane a predetermined amount to a second full stack orientation on the upper support surface of the table portion that is perpendicular to the first full stack orientation;

after said rotating step, pushing the rectangular full stack on the upper support surface of the table portion slidingly forwardly under the cutting blade at least once using the first pushing tool;

separating the rectangular full stack into a plurality of finished partial stacks using the cutting blade;

providing a receiving table disposed adjacent to an associated side of the cutting machine;

transferring the plurality of finished partial stacks onto the receiving table; and aligning the plurality of finished partial stacks on the receiving table to create a rectangular full finished stack.

2. A method as set forth in claim 1, including:

transferring the first and second partial stacks onto a rotary plate positioned in front of the table portion of the cutting machine to define an initial position;

pivoting the rotary plate with the first and second partial stacks thereon about an angle along a generally horizontal plane, so that the first and second partial stacks are positioned on the rotary plate in a second position that is generally perpendicular to the initial position;

transferring the first and second partial stacks disposed on the rotary plate onto the table portion of the cutting machine; and aligning the first and second partial stacks to create the rectangular full stack.

3. A method as set forth in claim 2, including:

transferring the first and second partial stacks onto the rotary plate in succession.

4. A method as set forth in claim 3, wherein:

said first and second partial stacks transferring step comprises transferring the first and second partial stacks onto the rotary plate in such a manner that the first and second partial stacks are in the configuration of the rectangular full stack.

5. A method as set forth in claim 4, wherein:

said rotary plate pivoting step comprises pivoting the first and second partial stacks disposed on the rotary plate 90 degrees.

6. A method as set forth in claim 5, including:

after said full stack separating step, arranging all of the finished partial stacks on the rotary plate, and transferring the arranged plurality of finished partial stacks as a unit onto the side receiving table.

7. A method as set forth in claim 1, including:

rotating the rectangular full stack created from the first and second partial stacks on a rear table portion of the table portion of the cutting machine.

8. A method as set forth in claim 7, wherein:

said rectangular full stack rotating step includes gripping and rotating the rectangular full stack with a rotary gripper disposed adjacent to the rear table portion of the cutting machine.

9. A method as set forth in claim 1, including:

edge-trimming the starting stack prior to said separating step which forms the first and second partial stacks.

10. A method as set forth in claim 1, including:

making intermediate cuts between said separating steps, and disposing of strips of waste created during the intermediate cuts.

11. A method as set forth in claim 1, wherein:

the first and second partial stacks transferred onto the table portion of the cutting machine are aligned on a back gauge and on a lateral stop portions of the cutting machine that is disposed generally perpendicular to the back gauge.

12. A method as set forth in claim 1, including:

pushing the plurality of finished partial stacks forwardly by using the first pushing tool.

13. A method as set forth in claim 1, including:

removing the full finished stack from the receiving table by a stacking unit, and placing the same onto a pallet or onto another full finished stack that has already been previously created and stacked on the pallet.

14. A method as set forth in claim 1, including:

after said second named separating step, immediately feeding another starting stack to a rear table portion of the cutting machine, edge-trimming the same, and pushing the same at least once for separating the second starting stack into third and fourth partial stacks.

* * * * *